US007149437B2

(12) United States Patent
Okubo

(10) Patent No.: US 7,149,437 B2
(45) Date of Patent: Dec. 12, 2006

(54) IMAGE FORMING APPARATUS, AND CONTROL SYSTEM, CARTRIDGE AND MEMORY MEDIUM FOR THE SAME APPARATUS

(75) Inventor: Kazuhiro Okubo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/924,923

(22) Filed: Aug. 25, 2004

(65) Prior Publication Data

US 2005/0047805 A1 Mar. 3, 2005

(30) Foreign Application Priority Data

Aug. 28, 2003 (JP) ..... 2003-304619
Aug. 17, 2004 (JP) ..... 2004-237396

(51) Int. Cl.
*G03G 15/08* (2006.01)
*G03G 15/10* (2006.01)

(52) U.S. Cl. ..... 399/27; 399/53; 399/58

(58) Field of Classification Search ..... 399/27, 399/30, 49, 61, 53, 58, 62, 111, 119
See application file for complete search history.

(56) References Cited

U.S. PATENT DOCUMENTS 4,908,666 A * 3/1990 Resch, III ..... 399/61
5,887,221 A * 3/1999 Grace ..... 399/49
5,923,917 A * 7/1999 Sakurai et al. ..... 399/27
6,160,971 A * 12/2000 Scheuer et al. ..... 399/58
6,535,699 B1 * 3/2003 Abe et al. ..... 399/27
2001/0005457 A1 * 6/2001 Serizawa ..... 399/12
2001/0036371 A1 * 11/2001 Ozawa et al. ..... 399/53

FOREIGN PATENT DOCUMENTS

JP 2002-72663 3/2002
JP 2002-296892 10/2002

* cited by examiner

*Primary Examiner*—Sandra L. Brase
(74) *Attorney, Agent, or Firm*—Fitzpatrick, Cella, Harper & Scinto

(57) ABSTRACT

The image forming apparatus onto which a cartridge having a developing apparatus and memory medium is detachably mountable, a detector for detecting toner concentration, and a control unit for selecting an operational mode from a first operational mode and second operational mode, wherein a toner supply member starts to supply a toner to the developing apparatus on the basis of a value detected by the detector in the first operational mode, and on the basis of a cumulative value of image signals for printing in the second operational mode, wherein the memory medium stores information based on which the second operational mode is switched to the first operational mode, and the control unit works to switch the second operational mode in operation to the first operational mode on the basis of information related to the cumulative value of image signals and information stored in the memory medium. This structure allows the image forming apparatus to keep toner concentration in the cartridge at an adequate level.

12 Claims, 10 Drawing Sheets

FIG. 8

CORRECTING VALUE TABLE

| PRINTING SHEET NUMBER / HUMIDITY | 1000 | 3000 | 5000 | 10000 | 15000 | 20000 |
|---|---|---|---|---|---|---|
| LOW TEMPERATURE LOW HUMIDITY | a1 | a2 | a3 | a4 | a5 | a6 |
| NORMAL TEMPERATURE NORMAL HUMIDITY | b1 | b2 | b3 | b4 | b5 | b6 |
| HIGH TEMPERATURE HIGH HUMIDITY | c1 | c2 | c3 | c4 | c5 | c6 |

IMAGE FORMING APPARATUS, AND CONTROL SYSTEM, CARTRIDGE AND MEMORY MEDIUM FOR THE SAME APPARATUS

BACKGROUND OF THE INVENTION

1. Field of the Invention

The present invention relates to an image forming apparatus for copiers, printers, facsimiles and the like which include a step of electrophotographically forming an image, and a control system, a cartridge and a memory medium for the same apparatus.

2. Description of Related Art

A two-component developer mainly composed of a toner and carrier has been used for a developing apparatus included in an apparatus for electrophotographically or electrostatically forming an image. Full-color image forming apparatuses, in particular, depend on development with a two-component developer in many cases, because it produces an image of higher stability, e.g., that associated with color tone, than other development methods.

As is well known, toner concentration of a two-component developer is a very important factor for stabilizing image quality, where toner concentration is defined as ratio of toner to toner and carrier totaled in this specification. A toner is consumed during the development step, and its concentration naturally varies. It is therefore necessary to keep toner concentration in a certain range around a given target level by an auto toner replenisher (hereinafter sometimes referred to as TR, which detects toner concentration as required and supplies an adequate quantity of the toner corresponding to its consumption.

An auto toner replenisher (ATR) generally comprises a toner concentration detecting means which detects toner concentration of developer, replenishing toner controlling means which processes the output data from the toner concentration detecting means to determine replenishing toner quantity, and toner supplying means which actually replenishes an image forming apparatus with the toner at a rate determined by the replenishing toner controlling means. Various types of toner concentration detectors have been developed.

These types include a photodetector which detects light reflectivity of developer in a developing container or on a developer carrier changing with toner concentration; an inductance detector which converts magnetic permeability of developer changing with toner concentration into an electrical signal; and a detector which detects changed light reflectivity of a given patch image formed under given conditions on a latent image bearing member to indirectly determine toner concentration of developer.

An image forming apparatus which produces a digital latent image using a laser scanner or LED array can relatively accurately estimate toner consumption per one page from a cumulative number of printed pixels (hereinafter referred to as "video count") in image information signals per 1 page. An auto toner replenishing controller (hereinafter referred to as "video count ATR"), which determines replenishing toner quantity according to the estimated consumption, has been developed. A video count ATR, needing no toner concentration detecting means, is greatly advantageous costwise, but involves a disadvantage of gradually accumulated errors of replenishing toner quantity. Therefore, it needs a means of some kind for correcting the accumulated errors, and has been rarely used by itself.

A color image forming apparatus equipped with two or more developing apparatuses has been demanded to include more compact developing apparatuses, including the detecting means. Therefore, an auto toner replenishing controller equipped with an inductance detector (hereinafter referred to as "inductance detecting system ATR") has been selected in many cases, because of its greatly saved space other than that for the detector itself.

Control of developer concentration by an inductance detector is generally based on detected data relative to a "standard value" determined by a procedure of some kind. When a developing apparatus is replenished with a developer whose toner concentration is accurately known, for example, its permeability reading is used as a standard value. Control of replenishing toner quantity is based on the standard value, memorized in the replenishing toner controlling means in such a way that the quantity is increased when the toner concentration is below the standard value, and vice versa since that the quantity is decreased or supply of the toner is stopped when it is above the standard value.

One of the problems involved in an inductance detecting system ATR is "agglomeration" of a developer as a result of a decreased gap between toner and carrier particles when it is kept out of service for extended periods (in particular in a high humidity atmosphere). Agglomeration of developer increases its bulk density and apparent permeability, possibly causing excessive replenishment, because toner concentration, although adequate, may be erroneously detected to be insufficient. Excessive supply of toner may deteriorate image concentration and color balances, possibly causing problems related to image quality, e.g., fogging. Another possible problem is increased scattering of toner to damage the image forming apparatus itself.

A combination of inductance detecting system ATR and video count ATR, described earlier, has been proposed to avoid the above-described problems by switching them from each other as required (as disclosed by, e.g., Japanese Patent Application Laid-Open No. 2003-66710). When a certain time is judged to elapse since last stoppage of image forming (when the apparatus is switched on, or out of service for extended periods with power switched on), the developer is judged to agglomerate when a difference between an inductance detecting system ATR reading and given standard value is above a given level, the combination mode is switched from an inductance detecting mode for toner replenishing controlling to a combination mode. A developer, once, agglomerated can return back gradually to the original state when sufficiently agitated and consumed at an adequate rate. The apparatus works in the combination mode until the agglomerated developer returns back to the original state, and then in the inductance detecting mode.

Recovery of a developer from agglomerated state can be judged when an inductance detecting system ATR reading attains a given level (which may be different from its reading when it is used in combination with a video count ATR, described above). It may be judged when another index, e.g., cumulative printed medium number, agitation time, quantity of toner supplied for replenishment or video count, or a value of function involving some of these parameters attains a given level.

The conventional control mode in which inductance detecting and video count ATRs are switched from each other is described by referring to the flowchart shown in FIG. 5.

First, when an image forming apparatus starts (S501) on receiving an image forming signal, the detected data "a" (data at the restart of the apparatus) as a detected voltage signal, which is AD-converted after being transmitted from the inductance head 20, is transmitted to CPU 67 (S502). At the same time, counting of the video count Cnew for image forming this time is started (S503). Next, an "initial value," and the correction values 1 and 2 corresponding to respective temperature/humidity conditions and medium number at the process cartridge 8 are read out from RAM 68 into CPU 67. They are transmitted to CPU 67, after being totaled to produce the standard value "b" (S504). Then, CPU 67 calculates the difference between the data "a" at the restart of the apparatus and data "b" at the stop of the apparatus (Δ=a−b) (S505). The difference Δ is compared with a given acceptable threshold "c" (S506). When Δ≦"c" (Yes), packing of a developer is judged not to occur, and an inductance detecting system ATR is brought into service for controlling toner concentration (S507) to supply toner for replenishment based on the data "a" at the restart of the apparatus (S508). When Δ>"c" (No), packing of developer is judged to occur, and a video count ATR is brought into service (S509). CPU 67 supplies a toner for replenishment based on the video count C1 obtained at the previous image forming time and transmitted to CPU 67 (S510). On completion of counting the video count Cnew (S511), it is used as the C1 for image forming (C1=Cnew), irrespective of how toner concentration is controlled, to renew the C1 stored in RAM 68 (S512). Packing will be solved while the above procedure is repeated to control toner concentration by a video count ATR. As soon as Δ≦"c" (Yes) is achieved, the video count ATR is switched to the inductance detecting system ATR for controlling toner concentration.

In the above-described system where the control mode is switched based on the difference Δ between an inductance ATR sensor reading and given standard value at the start of printing, however, packing of a developer remains unsolved when the apparatus is repeatedly kept out of service extended periods after printing a small number of media, with the result that control by the video count ATR continues. As a result, toner replenishment errors gradually accumulate to cause excessive or insufficient supply of toner, which may deteriorate image concentration and color balances, possibly causing problems related to image quality, e.g., fogging. When a video count ATR is continuously used for controlling toner concentration for extended periods, therefore, it should be switched to an inductance detecting system ATR at a given timing. A video count ATR may be switched to an inductance detecting system ATR based on service-related information of the developing apparatus (e.g., service time, quantity of toner supplied for replenishment, number of printed media or the like since the toner is supplied for replenishment), stored in a nonvolatile ROM in the image forming apparatus body. This can prevent excessive or insufficient supply of toner resulting from continued operation of a video count ATR.

An image forming apparatus may be structured in such a way that a process unit (cartridge) including a developing apparatus is easily attached to or detached from the image forming apparatus for improved maintenance. In this case, a working process unit (cartridge) may be exchanged by another one. Service-related information of a developing apparatus for a process unit (cartridge), when stored in an image forming apparatus body, differs from that for a substituted process unit (cartridge). When a working process unit (cartridge) is exchanged by another, therefore, timing for switching a video count ATR to an inductance detecting system ATR is unrelated to toner consumption for a substitute, leading to excessive or insufficient supply of toner. This may deteriorate image concentration and color balances, possibly causing problems related to image quality, e.g., fogging.

A packing tendency may vary depending on toner color, lot-to-lot variation or developer (toner and carrier) condition. In this case, a video count ATR may be switched to an inductance detecting system ATR before packing is sufficiently solved, or a video count ART continues to work after packing is solved, when switching timing is based on information stored in an image forming apparatus body. This may cause toner concentration (density) instability, image concentration and color balances, possibly causing problems related to image quality, e.g., fogging.

SUMMARY OF THE INVENTION

The objects of the present invention are to provide an image forming apparatus capable of keeping a toner concentration at an adequate level in a cartridge for the apparatus, a control system and cartridge for the apparatus, and a memory medium to be set in the cartridge.

Other objects of the present invention are to provide an image forming apparatus capable of forming an image while keeping toner concentration at an adequate level in a cartridge even when it is exchanged, a control system and a cartridge for the apparatus, and a memory medium to be set in the cartridge.

A further aspect of the invention is to provide an image forming apparatus on which a cartridge having a developing apparatus and memory medium is detachably mountable, the image forming apparatus comprising: a detector for detecting toner concentration, and a control unit for selecting an operational mode of the image forming apparatus from a first operational mode and second operational mode, wherein the first operational mode to supplies a toner to the developing apparatus on the basis of a value detected by the detector, and the second operational mode to supplies a toner to the developing apparatus on the basis of a cumulative value of image signals for printing, wherein the memory medium stores information to switch an operational mode of the image forming apparatus from the first operational mode to the second operational mode, the information being set in accordance with toner characteristics, and wherein when the image forming apparatus is active in the second operational mode, the control unit switches the operational mode of the image forming apparatus from the second operational mode in operation to the first operational mode on the basis of information related to the cumulative value of image signals and information stored in the memory medium.

Another aspect of the invention is to provide a cartridge detachably mountable onto an image forming apparatus including a detector for detecting toner concentration in a developing apparatus and supplying a toner on the basis of a value detected by the detector in a first operational mode and on the basis of a cumulative value of image signals for printing in a second operational mode, the cartridge comprising: the developing apparatus; and a memory medium having a memory region which stores information to switch an operational mode of the image forming apparatus from the first operational mode to the second operational mode, wherein the information is set according to toner characteristics.

A yet further aspect of the invention is to provide a memory medium to be set in a cartridge detachably mountable onto an image forming apparatus including a detector for detecting toner concentration in a developing apparatus and supplying a toner on the basis of a value detected by the detector in a first operational mode and on the basis of a cumulative value of image signals for printing in a second operational mode, wherein the cartridge includes the developing apparatus, and the memory medium has a memory region which stores information to switch an operational mode of the image forming apparatus from the first operational mode to the second operational mode, wherein the information is set according to toner characteristics.

A further object of the present invention is to provide a control system for an image forming apparatus having a detector for detecting toner concentration in a developing apparatus and operating a toner supply member on the basis of a value detected by the detector in a first operational mode and on the basis of a cumulative value of image signals for printing in a second operational mode, wherein the image forming apparatus is composed of the apparatus body and a cartridge, the cartridge is equipped with the developing apparatus and a memory medium having a memory region which stores information based on which the second operational mode is switched to the first operational mode, the apparatus is equipped with a control unit which selects an operational mode from the first and second operational modes, and the control unit switches the second operational mode to the first operational mode on the basis of the information on the cumulative value of image signals and information stored in the memory medium.

A still further object of the present invention will be understood by reading Detailed Description of the Invention, described below, by referring to the attached drawings.

BRIEF DESCRIPTION OF THE DRAWINGS

FIG. 8 presents a detailed correction value table used for an embodiment of the present invention;

DESCRIPTION OF THE PREFERRED EMBODIMENTS

Embodiment 1

Figure 1:
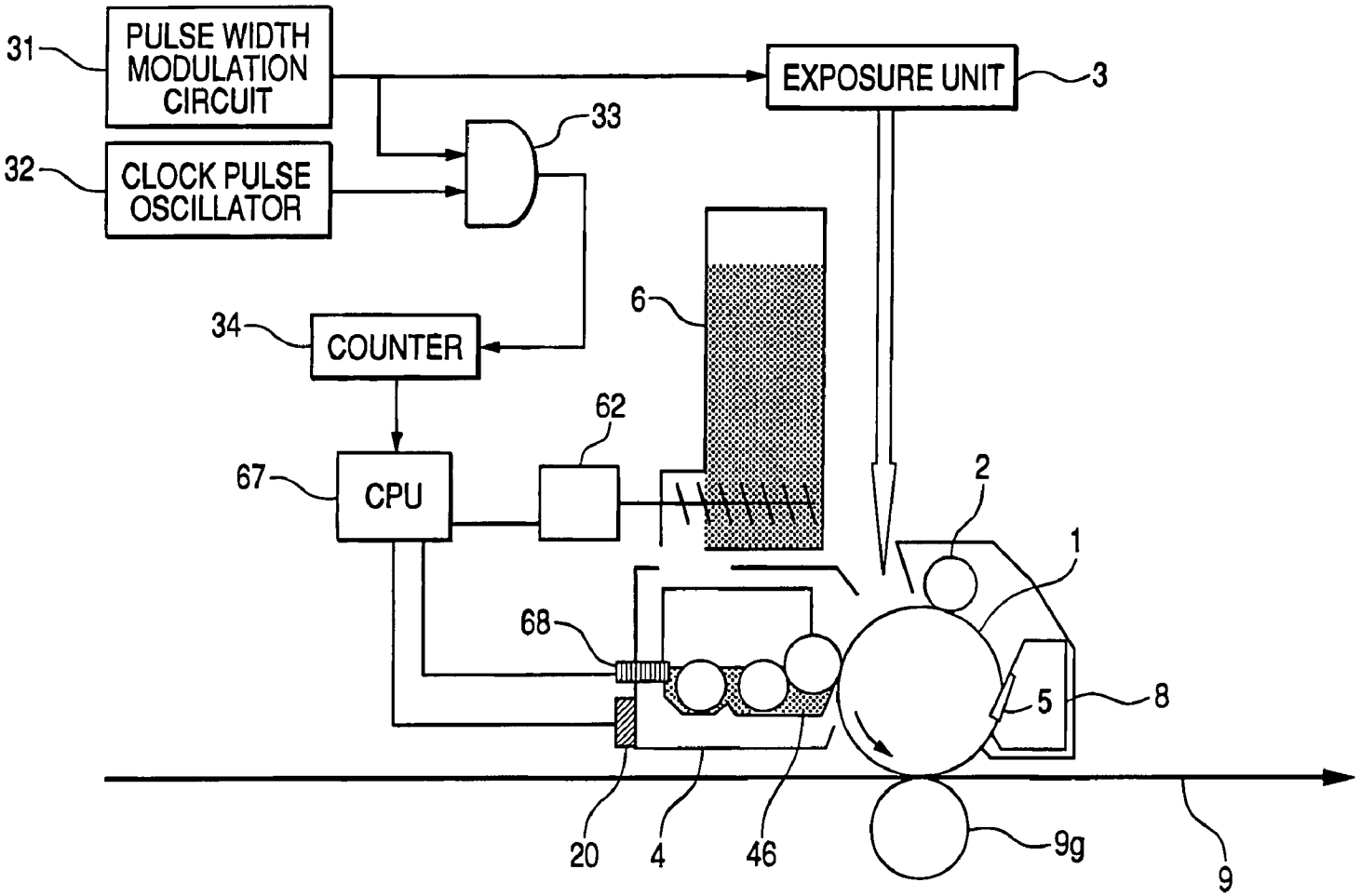
FIG. 1 illustrates an overall structure of an example of an image forming apparatus to which the present invention is applicable.

The image forming apparatus of the present invention is described in detail by referring to the drawings. The image forming apparatus to which the present invention is applicable is not limited so long as it forms a latent image corresponding to image information signal by an adequate means, e.g., electrophotographic or electrostatic means, on an image bearing member, e.g., photoreceptor or dielectric, develops the latent image by a developing apparatus with the aid of a two-component developer mainly composed of toner and carrier particles to form the visible image (toner image), transfers the visible image to a medium, e.g., paper, and fixes the transferred image by an adequate means to form the permanent image.

An overall structure of one embodiment of the image forming apparatus of the present invention is described by referring to FIG. 1. EMBODIMENT 1 describes the present invention applied to an electrophotographic digital copier. However, it is needless to say that the present invention is applicable to various types of image forming apparatus, including electrophotographic and electrostatic apparatuses. An image signal inputted via a PC or the like is converted into a pixel image signal corresponding to concentration at each pixel, after passing through an image processing circuit.

Next, the photosensitive drum 1 shown in FIG. 1, coated with amorphous silicon, selenium, OPC or the like and rotating in the arrowed direction, is uniformly charged by the primary charging roller 2.

The pixel image signal described above is inputted in the pulse width modulation circuit 31, and the laser-driven pulse corresponding to the pixel image signal is transmitted to a semiconductor laser in the exposure unit 3, to be emitted only for a time corresponding to the pulse width. The laser beams radiated from the semiconductor laser are scanned by a rotating polygonal mirror, and formed into an image on the photosensitive drum 1 by a lens (e.g., f/θ lens) or stationary mirror. As a result, an area-graded electrostatic latent image corresponding to an image information signal is formed on the photosensitive drum 1, exposed in the scanning direction over a longer range for pixels arranged at a higher density and shorter range for those arranged at a lower density.

The electrostatic latent image is developed with the two-component developer 46 composed of toner and carrier particles in the developing apparatus 4 to form the visual image (toner image). The toner image formed is transferred by the transfer roller 9*g* onto the endless, transfer material bearing belt 9 driven in the arrowed direction.

FIG. 1 shows only one image forming station, comprising the photosensitive drum 1, exposure means 3, charging roller 2, developing apparatus 4, cleaning means 5 and so on). A color image forming apparatus is provided with 4 image forming stations for, e.g., cyan, magenta, yellow and black colors on the transfer belt 9 in this order in the movement direction. A color-separated image of an original, formed on the photosensitive drum in the image forming station for each color is transferred orderly onto the transfer belt 9 to form the full-color image.

Figure 2:
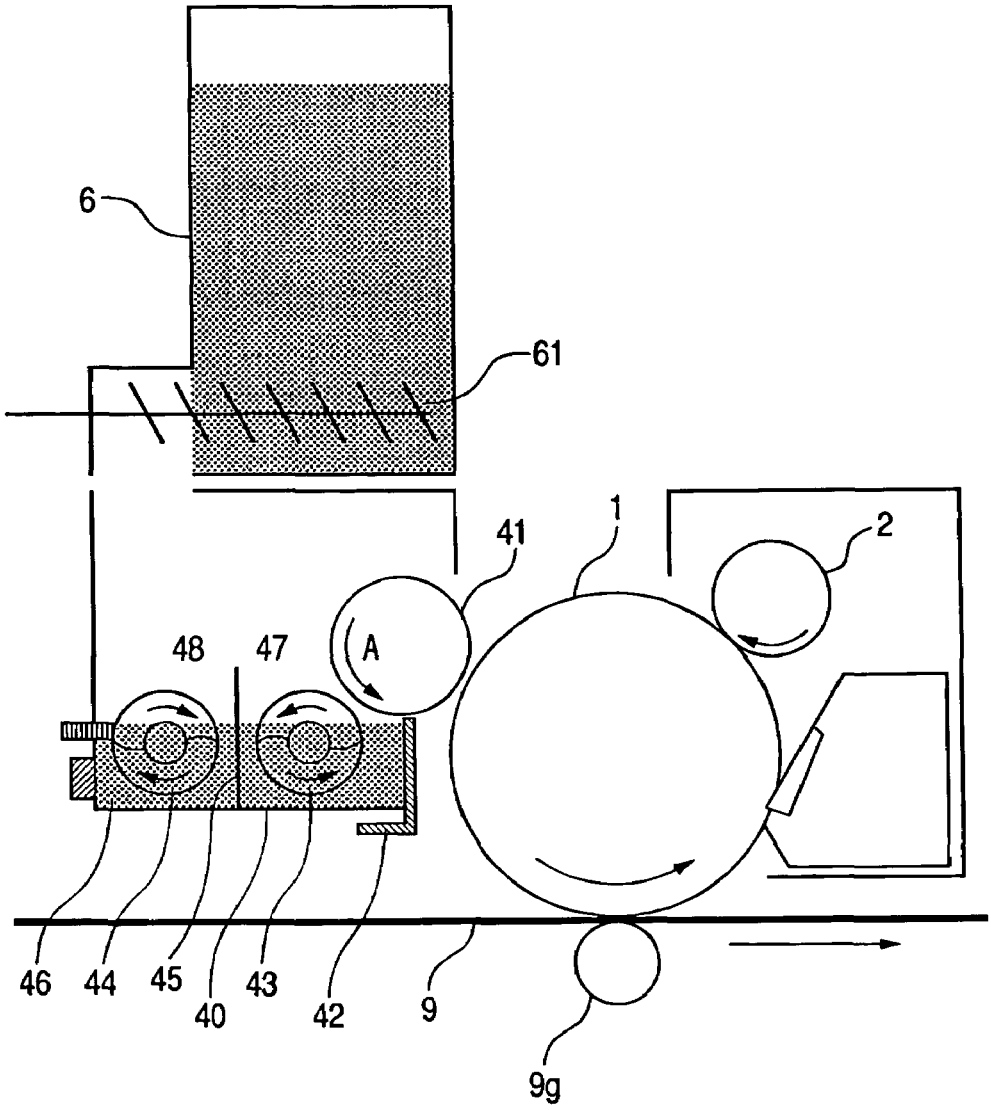
FIG. 2 structurally outlines a developing apparatus to be included in the image forming apparatus illustrated in FIG. 1.

The developing apparatus 4 is illustrated in detail in FIG. 2. The developing apparatus 4, arranged to face the photosensitive drum 1, is provided with the first chamber (developing chamber) 47 and second chamber (agitation chamber) 48 inside, which are separated from each other by the partition 45 extending vertically. The first chamber 47 includes the nonmagnetic developing sleeve 41 as a developer bearing member rotating in the direction of an arrow A, in which a magnet as a magnetic field generating means is fixed. The developing sleeve 41 carries/transfers a layer of two-component developer (composed of magnetic carrier and nonmagnetic toner particles), whose thickness is controlled by the blade 42 as a developer controlling member. The developer 46 is supplied to the photosensitive drum 1 to develop the electrostatic latent image in the developing region, which faces the photosensitive drum 1. A developing bias voltage with DC and AC voltage components overlapping each other is applied from a power source to the developing sleeve 41, to enhance developing efficiency, i.e., toner deposition rate to the latent image.

The first chamber 47 is provided with the first developer agitating screw 43, and the second chamber 48 with the second developer agitating screw 44, each of these screws serving as a developer agitating/transferring means. The first screw 43 agitates/transfers a developer in the first chamber 47, and the second screw 44 agitates/transfers a toner supplied by a toner supplying means from the toner supply tank 6 and the developer 46 already held in the developing apparatus to homogenize toner concentration, as shown in FIG. 1. The toner supplying means comprises the transfer screw 61 working as a toner supplying member which connects the toner supply tank 6 to the toner supply port in the developing apparatus 4, and driving unit 62 (including a driving motor and driving circuit for controlling the driving motor) for driving the transfer screw 61. The partition 45 is provided with developer passages (not shown) to keep the first chamber 47 and second chamber 48 in communication with each other in the near and far sides in FIG. 2. These chambers are structured in such a way that the developer having a lowered toner concentration is transferred from the first chamber 47 into the second chamber 48 via one passage, and the developer having a toner concentration recovered in the second chamber 48 is transferred from the chamber into the first chamber 47 via the other passage by the screws 43 and 44.

Figure 3:
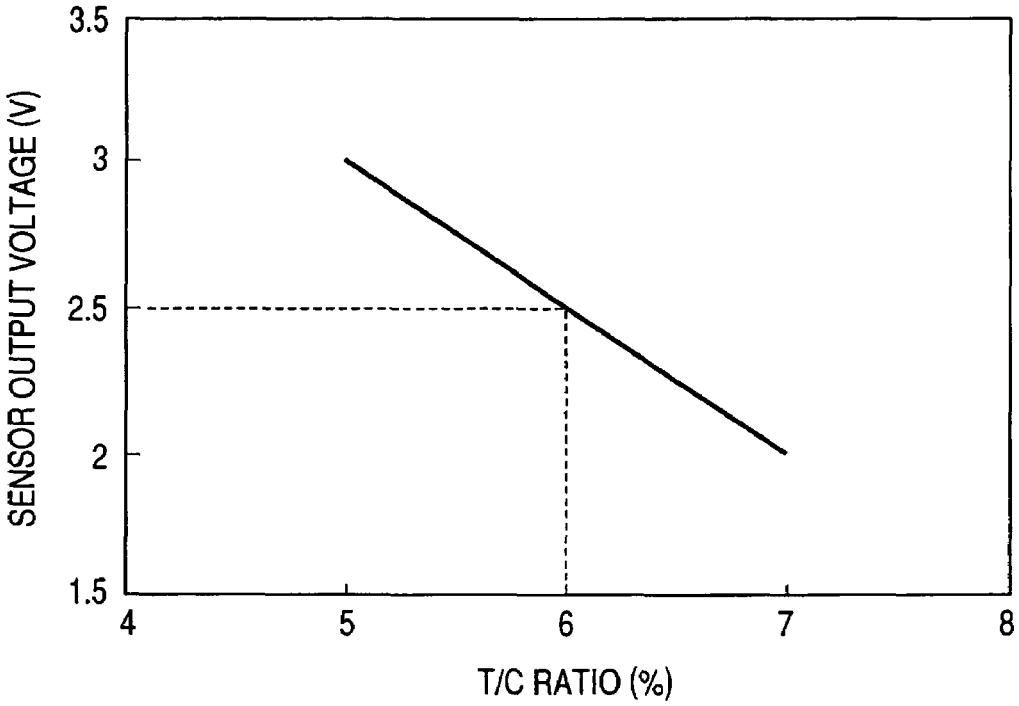
FIG. 3 presents a characteristic curve showing inductance sensor detecting signal changing with developing agent concentration.

In EMBODIMENT 1, the second chamber (developing chamber) 48 is equipped with the inductance head 20 for an inductance sensor on the basal wall, as shown in FIG. 1, to detect a changed toner concentration in the developing apparatus 4 to control a replenishing toner supply rate, as shown in FIG. 1. The output electrical signal from the inductance head 20, adjusted at 2.5V to secure an optimum toner concentration (6% in EMBODIMENT 1), changes almost linearly with toner concentration (T/C ratio (%)), as shown in FIG. 3. The detected data, which is the AD-converted output electrical signal from the inductance head 20, is transmitted to CPU 67 working as a replenishing toner controlling means. The developing apparatus 4 is provided with RAM 68, a nonvolatile memory working as an information memory section, which is in communication with CPU 67 via a memory access mechanism. The developing apparatus 4 composed at least of the inductance head 20 and memory 68 is structured to work as the detachable process unit 8.

In EMBODIMENT 1, capacity of the carrier to impart tribo to the toner changes as a result of aging, and so does sensitivity of the induction sensor as a result of fluctuating temperature/humidity conditions. Therefore, RAM 68 as a nonvolatile memory stores information for correcting a given toner concentration (set level of initial concentration) in consideration of anticipated variations of the initial level in the developing apparatus, based on which the set level of initial concentration is corrected by an adequate correction value selected from those related to aging extent of carrier in a developer (estimated from measured cumulative number of printed media), fluctuation of atmosphere conditions (temperature, humidity and the like) detected by a built-in temperature/humidity sensor (not shown), and the like. A "set level of initial concentration" plus "correction value" is used as a standard value.

Figure 7:
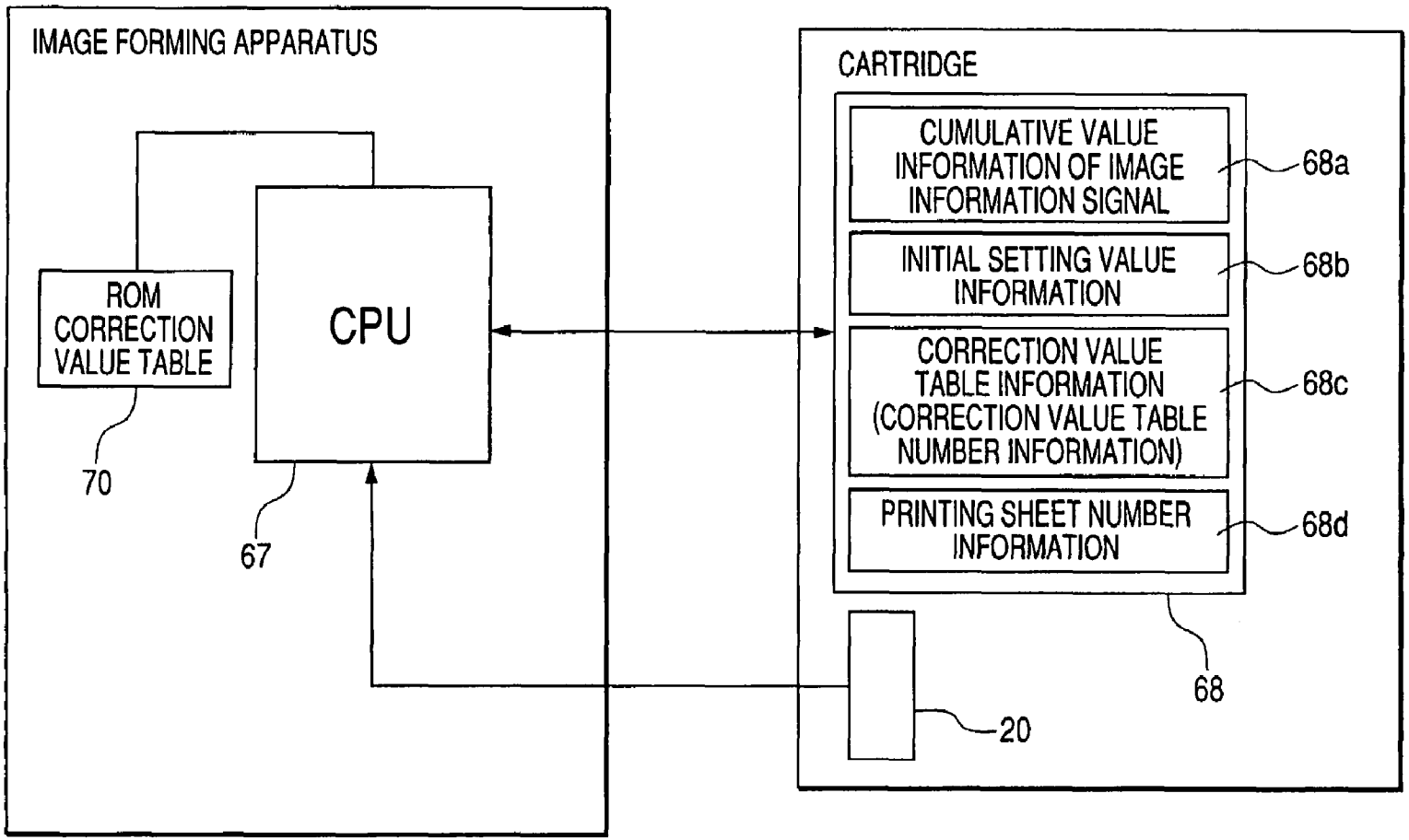
FIG. 7 presents a detailed structure of a nonvolatile memory to be included in the developing apparatus of EMBODIMENT 1.

More specifically, referring to FIG. 7, RAM 68 stores the data related to a given toner concentration (i.e., "information related to set level of initial toner concentration," e.g., 2.5V corresponding to 6% shown in FIG. 3), temperature/humidity conditions, given correction value table information corresponding to number of media printed with an image using the process cartridge 8 provided with the developing apparatus 4, and number of image-printed media in the respective memory regions 68*a*, 68*b*, 68*c* and 68*d*.

The correction value table itself is stored in two or more units, e.g., ROM 70, in the image forming apparatus body, and RAM 68 stores number information by which an adequate correction value table stored in the image forming apparatus body is selected. The inductance sensor output corresponding to temperature/humidity changes slightly varies when characteristics and color of the toner to be supplied change. Therefore, two or more correction value tables each corresponding to, e.g., toner characteristics or color, are stored.

In EMBODIMENT 1, initial toner concentration information, correction value table number information as information of correction value table and number of printed media are read out from RAM 68 into CPU 67, which selects correction value tables corresponding to the table numbers from the image forming apparatus body, and reads out correction values from the selected tables for detected temperature/humidity conditions and information related to number of printed media, which is read out from RAM 68, to find a "standard value" by adding the correction values to the initial toner concentration.

FIG. 8 presents one example of the correction value table which gives correction values for temperature/humidity and number of printed media, more specifically those corresponding to number of printed media for high temperature/high humidity, normal temperature/normal humidity and low temperature/low humidity conditions. Two or more correction value tables are stored in the image forming apparatus for toner characteristics and color.

This table gives a standard value of $\alpha$+b3 when 5000 media are printed under normal temperature and humidity conditions, where $\alpha$ represents initial toner concentration information.

As discussed above, toner replenishment can be accurately controlled in EMBODIMENT 1 by correcting, based on information stored in RAM 68 in the developing apparatus 4, a set level of initial toner concentration in consideration of temperature/humidity conditions under which the apparatus works and number of printed media.

CPU 67 compares the detected data newly transmitted from the inductance head 20 with the standard level described above, calculates working time of the transfer screw to supply a toner to the developing apparatus 4, if the difference indicates shortage of toner, and controls the driving unit 62 to run the motor for that time. The transfer screw 62 works for that time to supply a toner from the toner supply tank 6 to the developing apparatus 4 to eliminate the shortage. In other words, it controls toner supply by controlling driving period of the motor. When excessive supply of toner is detected, CPU 67 calculates an excessive quantity of the toner in the developer, and controls, in subsequent image formation from an original, to eliminate the excess by reducing toner supply or stopping the supply until the excess toner is depleted. The normal toner supply will be restarted, when the excessive toner is depleted.

A toner is supplied while the first and second developer agitating screws 43 to 44 are driven to prevent uneven distribution of its concentration. A color image forming apparatus or the like equipped with two or more developing apparatuses, e.g., the one used in EMBODIMENT 1, frequently has the developing sleeve 41 and first and second developer agitating screws 43 to 44 driven by the same driving system to reduce cost. In such a structure, a toner can be supplied only while an image is being formed.

Figures 4A, 4B, 4C:
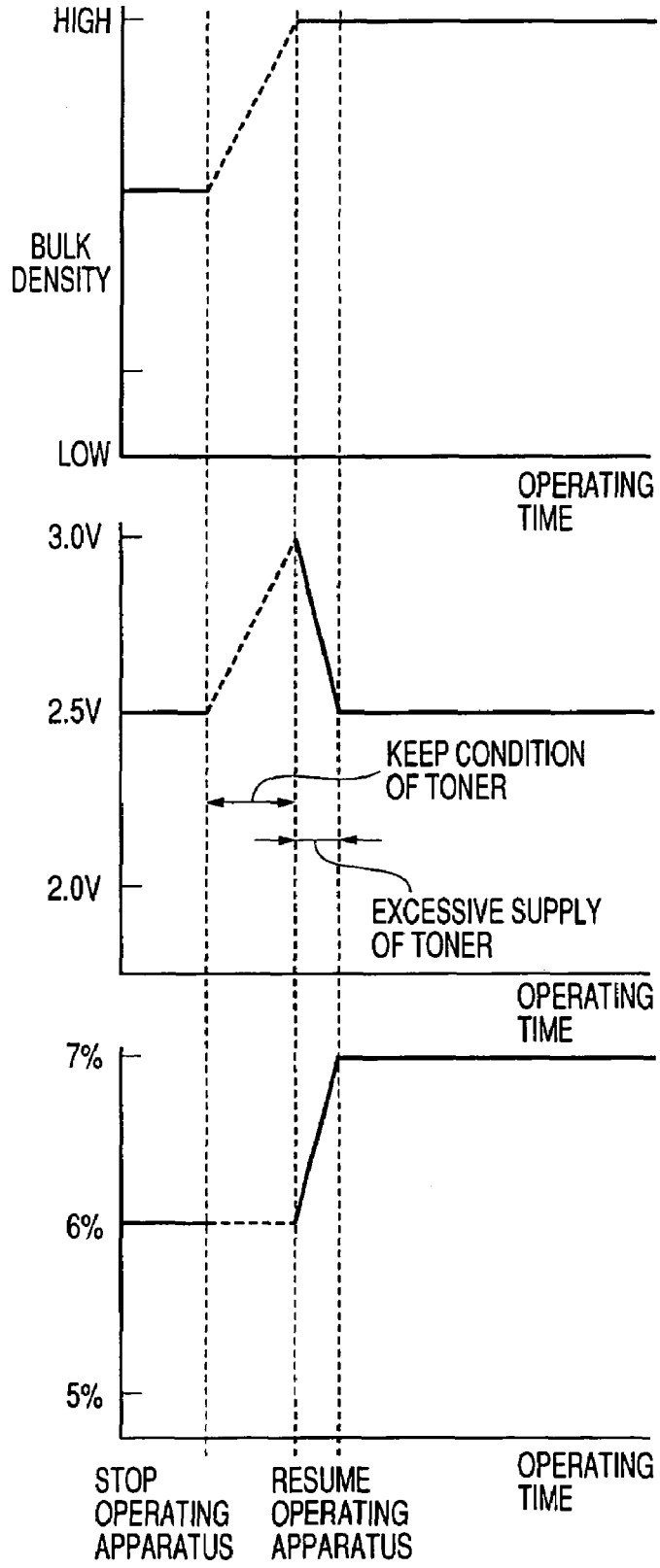
FIGS. 4A, 4B and 4C illustrate a mechanism of erroneous detection by an inductance detecting ATR system as a result of agglomeration of developing agent.
Figure 5:
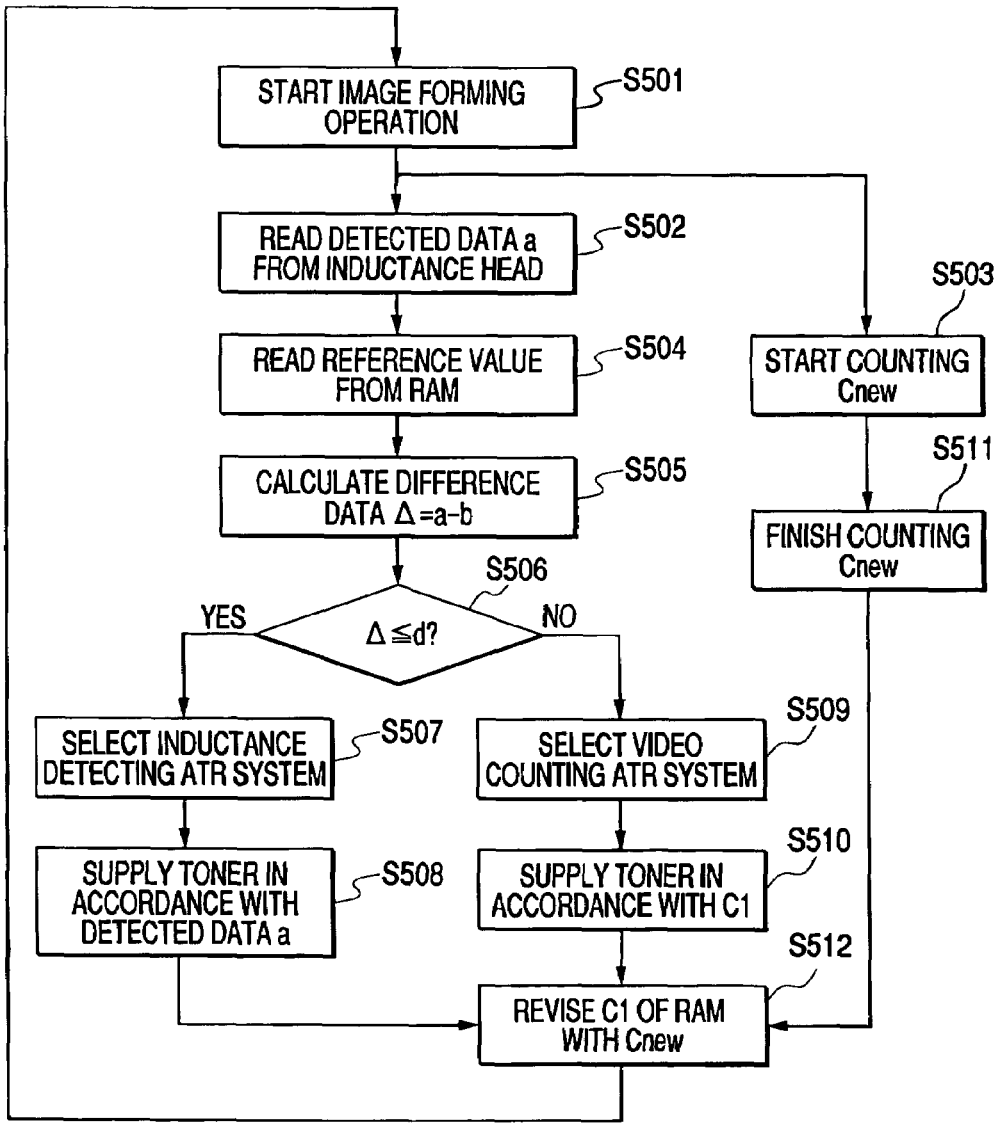
FIG. 5 PRIOR ART
FIG. 5 is a flowchart illustrating switching toner concentration control mode in a related art.

In the above-described structure, packing of a developer may occur when it is kept out of service for extended periods to change a signal detected by inductance detecting system ATR in spite of constant toner concentration, as discussed in Description of the Related Art, causing erroneous control of toner concentration. For example, developer bulk density may increase when it is kept out of service for extended periods, as shown in FIG. 4A, or the detected data may increase when it is restarted, as shown in FIG. 4B. Therefore, CPU 67 may judge that a developer has an insufficient toner content and attempt to supply toner excessively to reduce the detected data value. As a result, toner content, which is optimum at 6%, is stabilized at a higher level, as shown in FIG. 4C. A condition of excessive toner concentration will continue until developer packing is eliminated.

Therefore, the apparatus of EMBODIMENT 1 controls developer concentration by a video count ATR as a second developer concentration controlling means to correct erroneous detection by an inductance detecting system ATR when it is kept out of service for extended periods and thereby to keep toner concentration at a given level as soon as it is restarted.

The video count ATR for the apparatus of EMBODIMENT 1 will now be described.

Referring to FIG. 1, a laser-driven pulse signal corresponding to a pixel image signal transmitted from the pulse width modulation circuit 31 is supplied to one input port of the AND gate 33, and a clock pulse signal transmitted from the clock pulse oscillator 32 is supplied to the other input port. The AND gate 33 outputs the clock pulses, number of which corresponds to width of the laser-driven pulses, i.e., to concentration of each pixel. The counter 34 adds up the clock pulses for each pixel to produce a video count C1 (for example, it is 400 dpi at the maximum for one A4-size sheet, and around $3884\times10^6$ for 256 gradations). The video count corresponds to toner quantity consumed to form one toner image of the image signals. CPU 67 reads out, based on the video count, a conversion table stored in RAM 68 for relationship between video count and toner supply time, and controls driving time of the supply unit 62 to compensate for the consumed toner.

However, continued control of developer concentration by a video count ATR will gradually accumulate errors. Therefore, it should be switched to an inductance detecting system ATR at a given timing.

Figure 6:
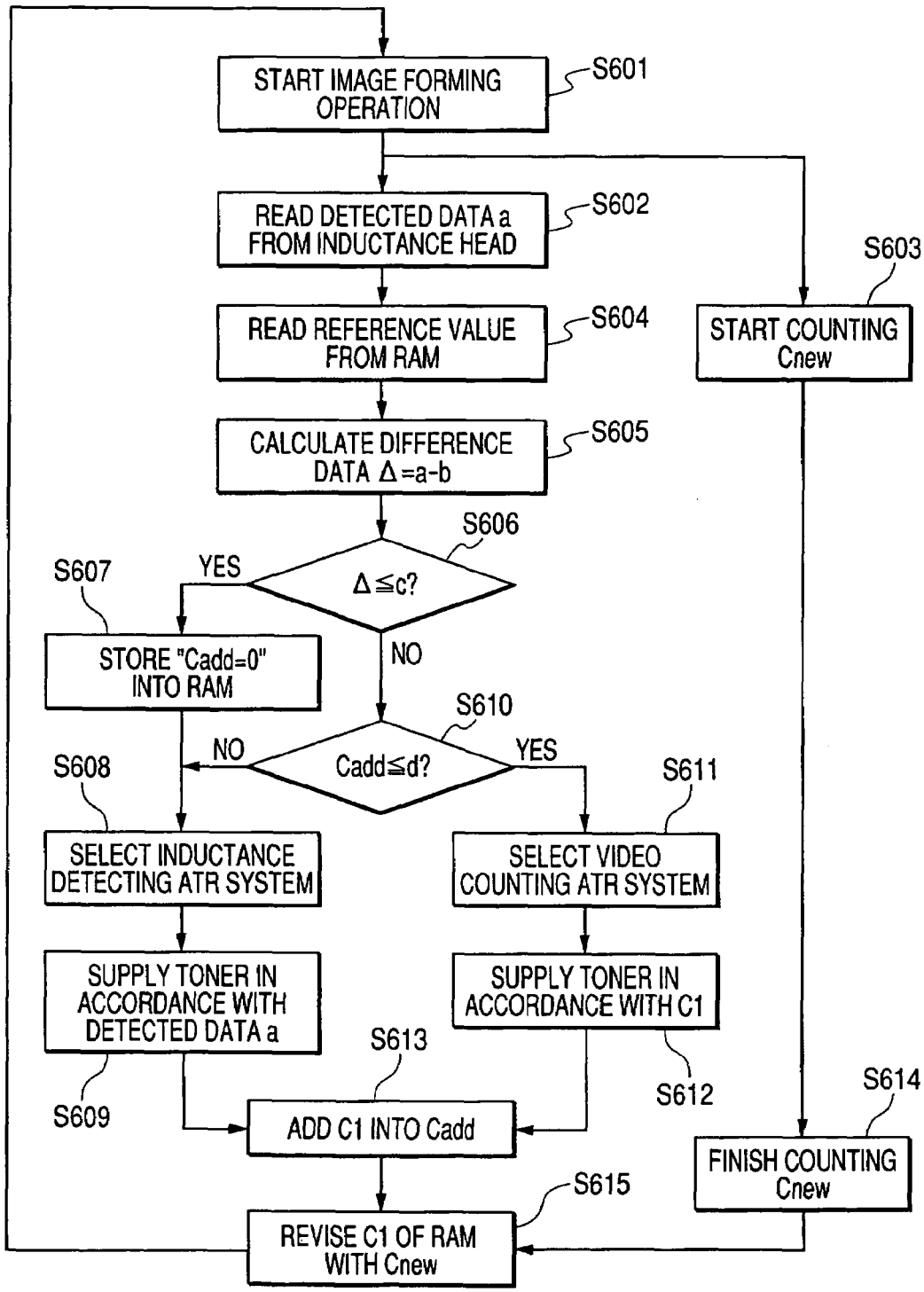
FIG. 6 is a flowchart illustrating switching toner concentration control mode in an embodiment of the present invention.

The control mode of EMBODIMENT 1 in which inductance detecting and video count ATRs are switched from each other is described by referring to the flowchart shown in FIG. 6.

The control mode based on the flowchart illustrated in FIG. 6 is carried out by reading out the program stored in ROM (not shown) or the like in CPU 67.

First, when the image forming apparatus starts (S601) on receiving an image forming signal, the detected data "a" (data at the restart of the apparatus) as a detected voltage signal, which is AD-converted after being transmitted from the inductance head 20, is transmitted to CPU 67 (S602). At the same time, counting of the video count Cnew for image forming this time is started (S603). Next, initial toner concentration information, correction value table number information as correction value table information, number of printed media and cumulative image signal information (Cadd) are read out from RAM 68 into CPU 67, which selects the correction values for temperature/humidity conditions and number of printed media using correction value table number information and number of printed media, to find a standard value "b" by adding the correction values to the initial toner concentration (S604). Then, CPU 67 calculates the difference between the detected data "a" and standard value "b" ($\Delta=a-b$) (S605). The difference $\Delta$ is compared with a given acceptable threshold "c" (S606). When $\Delta\leqq$"c" (Yes), packing of a developer is judged not to occur, and the data Cadd=0 is stored in RAM 68 (S607). The cumulative image signal information (Cadd) represents a cumulative value of toner quantity to be supplied, detected by the video count ATR after packing of a developer occurs (cumulative image information signals shown in FIG. 8). The signals are continuously added up until developer packing is judged to be eliminated. When $\Delta>$"c" (No), packing of developer is judged to occur.

When packing of developer is judged not to occur, an inductance detecting system ATR is brought into service for controlling toner concentration (S608), to operate toner supply based on the detected data "a" (S609).

When packing of developer is judged to occur, a cumulative video count value Cadd is compared with a given value "d" (S610). When Cadd$\leqq$"d" (Yes), a video count ATR is brought into service (S611), and CPU 67 supplies a toner for replenishment based on the video count C1 obtained at the previous image forming time and transmitted to CPU 67 (S612).

When packing of developer is judged to occur, a cumulative video count value Cadd is compared with a given value "d" (S610). When Cadd>"d" (No), supply by a video count ATR is judged to exceed a given level, and it is switched to an induction detecting system ATR.

On completion of toner supply, C1 is added to Cadd (S613). On completion of counting the video count Cnew (S614), it is used as the C1 for image forming (C1=Cnew), irrespective of how toner concentration is controlled, to renew the Cadd stored in RAM 68 (S615).

The given value "d" described above, although not shown, is stored as a fixed value in a nonvolatile memory means (ROM or the like) in the image forming apparatus body.

EMBODIMENT 1 stores the cumulative value Cadd (cumulative information of image information signals), a video count value counted for every occasion of image formation, in RAM 68. This allows calculation of a total quantity of toner supplied under continued control of a video count ATR, and thereby to switch it to an inductance detecting system ATR. At the same time, as RAM 68 is set in the process cartridge 8, the data related to toner supply under control of a video count ATR (cumulative information Cadd of image information signals) is kept even when the cartridge is exchanged, which allows the ATR to be switched to an inductance detecting system ATR under continued control of a video count ATR.

Embodiment 2

The image forming apparatus of EMBODIMENT 1 switches an inductance detecting system ATR to a video count ATR for controlling toner supply when developer packing is judged to occur, and then switches latter ATR back to the former ATR when a cumulative video count exceeds a given level, i.e., supply of toner under a control of a video count ATR exceeds a given level, to keep toner concentration at an adequate level.

The image forming apparatus of EMBODIMENT 2, on the other hand, compares a cumulative video count in the video count ATR controlling mode with a given value determined in accordance with developer color, type, characteristics and the like as cumulative video count threshold information, which is stored in a memory means in a cartridge and used when a video count ATR is switched to an inductance detecting system ATR in accordance with developer color, type, characteristics.

The given value to be compared with a cumulative video count is determined in accordance with color, type, characteristics and the like of a toner in a developer for the following reasons.

When packing of a developer left unused for extended periods occurs, a time required for eliminating packing varies depending on color, type, characteristics and the manufacturing conditions of its toner. Therefore, switching a video count ART to an inductance detecting system ATR when a cumulative video count relative to a fixed value stored in the image forming apparatus body exceeds a given level, as is the case with EMBODIMENT 1, may cause problems, e.g., the video count ART is switched although packing is not eliminated yet, or conversely continues to run although packing is eliminated, departing toner concentration out of an adequate range.

The image forming apparatus of EMBODIMENT 2 controls developer concentration by a video count ATR as a second developer concentration controlling means, which is brought into service as soon as a developer is left unused, to keep toner concentration at a given level by correcting erroneous detection by an inductance detecting system ATR. At the same time, it switches a video count ATR to an inductance detecting system ATR for controlling developer concentration in accordance with color, type, characteristics and the like of a toner in a developer held in a process cartridge. In other words, it controls switching for each cartridge.

The structure and control modes of the image forming apparatus of EMBODIMENT 2 are described below only for those features different from those of EMBODIMENT 1, omitting a description of the common features.

Figure 9:
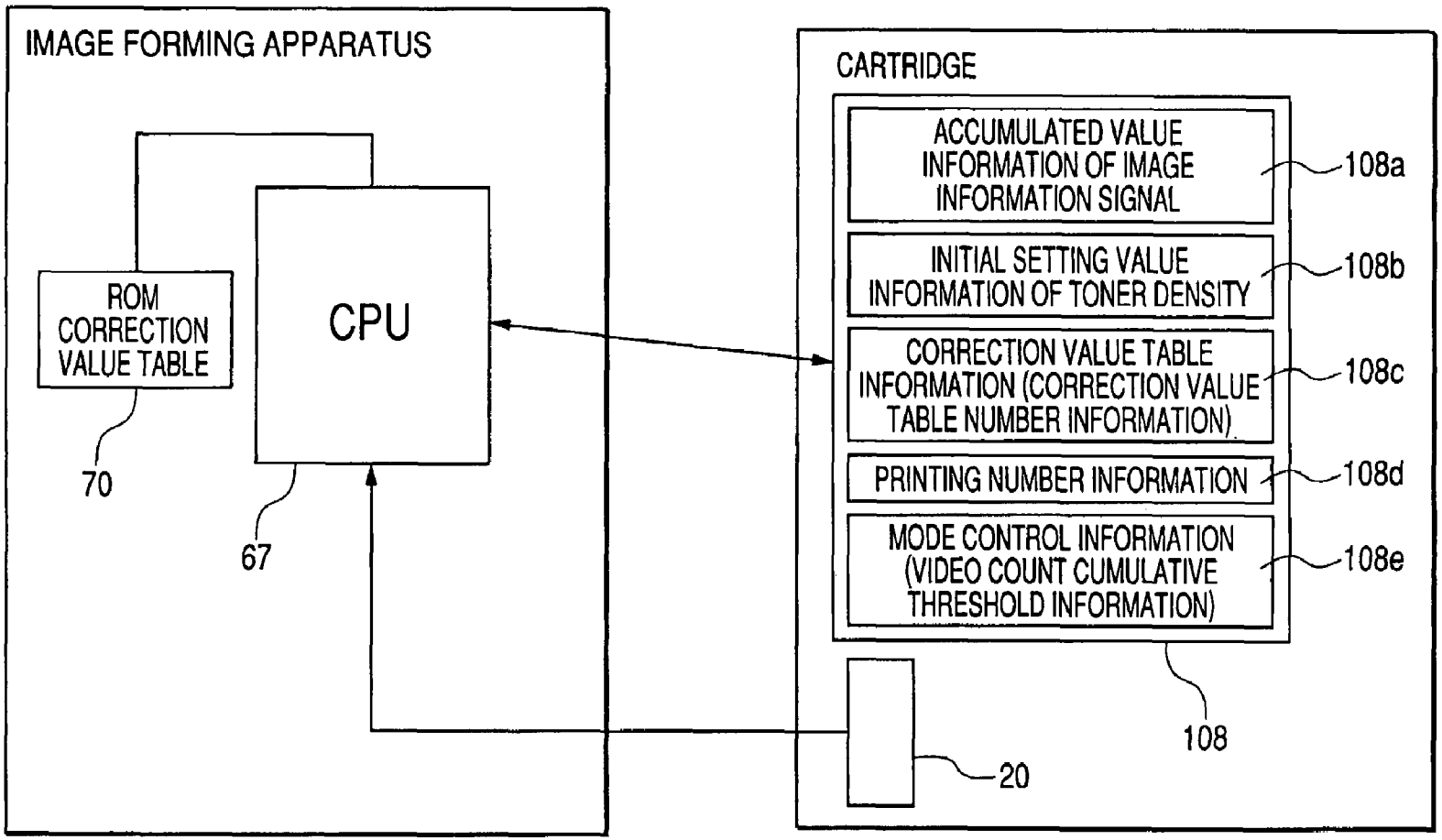
FIG. 9 presents a detailed structure of a nonvolatile memory to be included in the developing apparatus of EMBODIMENT 2.

FIG. 9 illustrates the data stored in RAM 108 as a memory means in a cartridge for the image forming apparatus of EMBODIMENT 2. As described above, the apparatus stores cumulative video count threshold information as new information in the memory region 108*e*, unlike the apparatus of EMBODIMENT 1. It is mode controlling information by which timing of switching a video count ATR to an inductance detecting system ATR is controlled.

The cumulative video count threshold information as mode controlling information is determined in accordance with color, type, characteristics and the like of a toner in a developer held in a cartridge. It can be read out to control toner concentration at an adequate level, even when the cartridge is detached, for example, to be attached to another image forming apparatus.

The image forming apparatus of EMBODIMENT 2 reads out cumulative video count threshold information from, e.g., RAM 108 (S604), before a cumulative toner supply quantity (cumulative video count value) detected by a video count ATR is compared with a given value (S610) after packing occurs (refer to the flowchart for EMBODIMENT 1, shown in FIG. 6). Then, it compares a cumulative video count with the cumulative video count threshold information read out from RAM 108 (S610) to switch a video count ATR to an inductance detecting system ATR, as required. In other words, it controls timing of switching a video count ATR to an inductance detecting system ATR by CPU 67. This allows switching the control mode in accordance with color, type, characteristics and the like of a toner.

Figure 10:
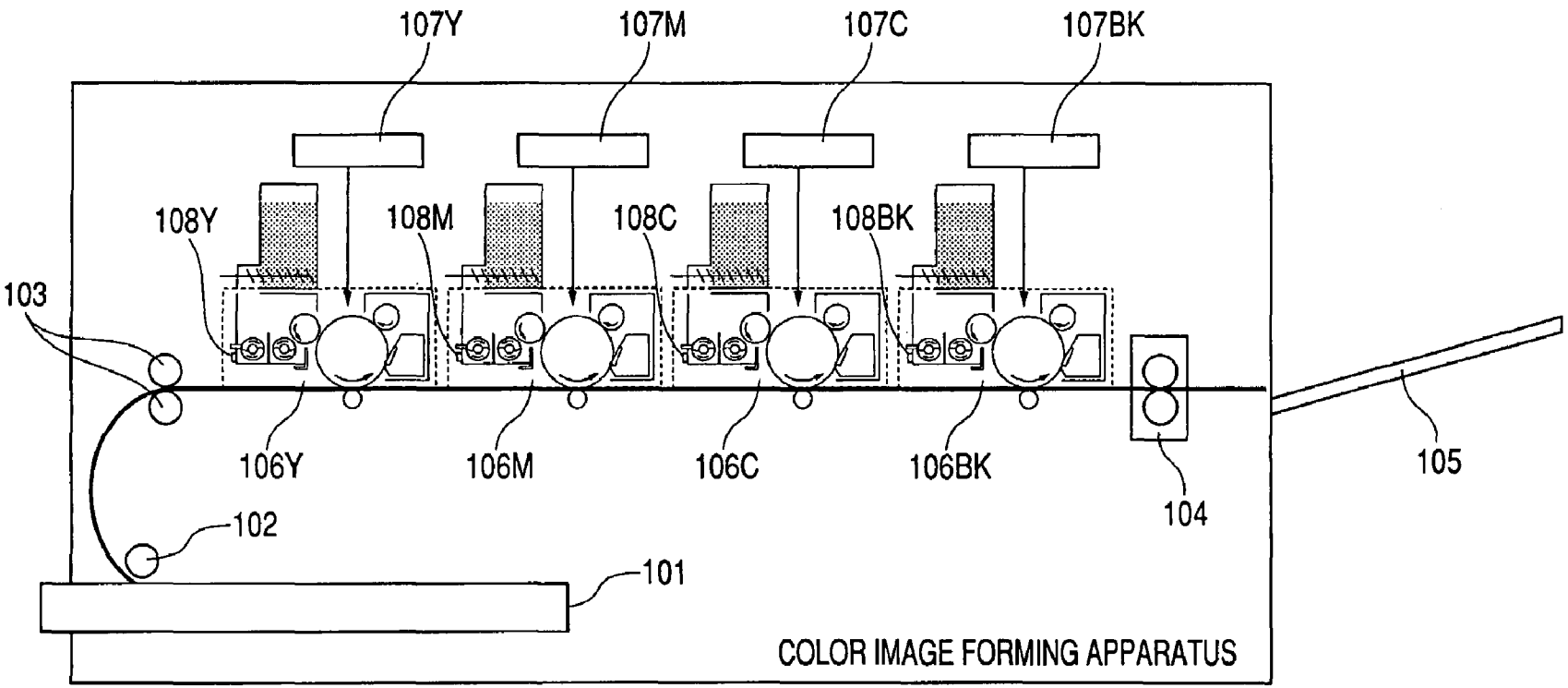
FIG. 10 exemplifies a structure of the color image forming apparatus prepared in EMBODIMENT 2.

FIG. 10 illustrates a color image forming apparatus structure as one example to which the present invention is applicable.

The color image forming apparatus illustrated in FIG. 10 supplies a medium (e.g., paper) to which an image is transferred, held in the cassette 101, by the paper supplying roller 102. The medium is then transferred by the registration roller 103 while being kept time to image formation by the yellow cartridge 108Y (transferring an image from the photosensitive drum 1 to the medium), after being temporarily stopped at the registration roller 103. In FIG. 10, 107Y, 107M, 107C and 107Bk are exposure units for exposing the photosensitive drums in the cartridges for yellow, magenta, cyan and black colors, respectively. They expose the photosensitive drums for the yellow (106Y), magenta (106M), cyan (106C) and black (106BK) cartridges, based on image information transmitted from a host computer (not shown) or the like to form the latent images, which are developed by the developing apparatus in each cartridge. These developed images are transferred to a recording medium orderly to form the color image thereon, and fixed by the fuser 104. The medium printed with the fixed image is discharged to the paper discharging tray 105.

Each of these cartridges, 106Y, 106M, 106C and 106BK for yellow, magenta, cyan and black colors, respectively, is provided with a memory means (RAM 108Y, RAM 108M, RAM 108C or RAM 108BK, respectively) to store cumulative video count threshold information according to color of the toner and the like. Therefore, the color image forming apparatus of EMBODIMENT 2 can control timing of switching a video count ATR to an inductance detecting system ATR for each cartridge according to the threshold information read out from each memory means to keep toner concentration in the developing apparatus at an adequate level.

The color image forming apparatus illustrated in FIG. 10 is structured to transfer an image from a photosensitive drum in each cartridge to a medium. The structure to which the present invention is applicable is not limited to the above-described embodiments. For example, the present invention is applicable to a structure in which an image is transferred from a photosensitive drum in each cartridge to an intermediate medium (e.g., intermediate transfer belt or drum), and then these images are transferred in a lump to a final medium.

The image forming apparatuses of EMBODIMENTS 1 and 2 adopt a two-component development system with a developer composed of toner and carrier. However, the present invention is applicable also to a magnetic, one-component development system with a developer comprising a toner only.

As discussed above, the image forming apparatus of the present invention can form an image while keeping toner concentration in its development apparatus at an adequate level.

Moreover, the image forming apparatus of the present invention with an inductance detecting system ATR and video count ATR interchangeably switched from each other can keep toner concentration in a detachable process cartridge provided in its development apparatus at an adequate level, even when the cartridge is exchanged, when provided with a memory means in the cartridge.

The present invention can also provide an image forming apparatus capable of forming an image while keeping toner concentration at an adequate level in a cartridge even when it is exchanged to another cartridge of different toner condition, control system and cartridge for the apparatus, and memory medium to be set in the cartridge.

The present invention is not limited to the described in EMBODIMENTS, and variations may be made within the technical concept of the invention.

This application claims priority from Japanese Patent Application No. 2003-304619 filed Aug. 28, 2003 and No. 2004-237396 filed Aug. 17, 2004, which are hereby incorporated by reference herein.

What is claimed is:

1. An image forming apparatus to which a cartridge having a developing apparatus and memory medium is detachably mountable, the image forming apparatus comprising:

a detector for detecting toner concentration; and a control unit for selecting an operational mode of the image forming apparatus from a first operational mode and second operational mode, wherein the first operational mode supplies a toner to the developing apparatus on the basis of a value detected by the detector, and the second operational mode to supplies the toner to the developing apparatus on the basis of a cumulative value of image signals for printing, wherein the memory medium stores information to switch an operational mode of the image forming apparatus from the second operational mode to the first operational mode, the information being set in accordance with toner characteristics, and wherein when the image forming apparatus is operative in the second operational mode, the control unit switches the operational mode of the image forming apparatus from the second operational mode in operation to the first operational mode on the basis of information related to the cumulative value of image signals and information stored in the memory medium.

2. An image forming apparatus according to claim 1, wherein the control unit switches the operational mode of said image forming apparatus from the first operational mode to the second operational mode based on a value detected by the detector.

3. An image forming apparatus according to claim 2, wherein the memory medium further stores information related to a predetermined standard value, and wherein said control unit switches the operational mode of the image forming apparatus from the first operational mode to the second operational mode on the basis of the value detected by the detector and the predetermined standard value.

4. An image forming apparatus according to claim 1, wherein the information stored in the memory medium is cumulative threshold information of the image signals.

5. An image forming apparatus according to claim 4, wherein the control unit switches the second operational mode to the first operational mode when information relating to the cumulative value of the image signals attains the cumulative threshold information of the image signal.

6. A cartridge detachably mountable onto an image forming apparatus including a detector for detecting toner concentration in a developing apparatus and supplying a toner on the basis of a value detected by the detector in a first operational mode and on the basis of a cumulative value of image signals for printing in a second operational mode, the cartridge comprising:

the developing apparatus; and a memory medium having a memory region which stores information to switch an operational mode of the image forming apparatus from the second operational mode to the first operational mode, wherein the information is set according to toner characteristics.

7. A cartridge according to claim 6, wherein said memory medium further having a memory region which stores information related to a predetermined standard value in the first operational mode.

8. A cartridge according to claim 6, wherein the information to switch the operational mode of the image forming apparatus from the second operational mode to the first operational mode is information relating to a cumulative threshold value of the image signals.

9. A cartridge according to claim 6, further including the detector.

10. A memory medium to be set in a cartridge detachably mountable onto an image forming apparatus including a detector for detecting toner concentration in a developing apparatus and supplying a toner on the basis of a value detected by the detector in a first operational mode and on the basis of a cumulative value of image signals for printing in a second operational mode, wherein the cartridge includes the developing apparatus, and the memory medium has a memory region which stores information to switch an operational mode of the image forming apparatus from the second operational mode to the first operational mode, wherein the information is set according to toner characteristics.

11. A memory medium according to claim 10, further comprising a memory region which stores the information relating to a predetermined standard value to supply the toner in the first operational mode.

12. A memory medium according to claim 10, wherein the information to switch the operational mode of the image forming apparatus from the second operational mode to the first operational mode is information relating to a cumulative threshold value of the image signals.

* * * * *

UNITED STATES PATENT AND TRADEMARK OFFICE

CERTIFICATE OF CORRECTION

PATENT NO. : 7,149,437 B2
APPLICATION NO. : 10/924923
DATED : December 12, 2006
INVENTOR(S) : Kazuhiro Okubo It is certified that error appears in the above-identified patent and that said Letters Patent is hereby corrected as shown below:

COLUMN 1:
Line 31, “as TR” should read --as ATR),--.
Line 59, “1 page.” should read --one page.--.

COLUMN 2:
Line 19, “since that” should read --since--.
Line 47, “agglomerated” should read --agglomerated,--.

COLUMN 4:
Line 35, “mode to” should read --mode--.
Line 37, “mode to” should read --mode--.

COLUMN 5:
Line 28, “Detailed Description of” should read --Description of the Preferred Embodiments--; “the Inven-” should be deleted.
Line 29, “tion, described” should be deleted; and “by referring” should read --and by referring--.

COLUMN 6:
Line 44, “endless,” should read --endless--.
Line 49, “on).” should read --on.--; and “with 4” should read --with four--.
Line 54, “color” should read --color,--.

COLUMN 9:
Line 39, “number” should read --the number--.

COLUMN 10:
Line 53, “to switch it” should read --switching--.

COLUMN 11:
Line 22, “video count ART” should read --video count ATR--.
Line 26, “video count ART” should read --video count ATR--.

COLUMN 12:
Line 15, “while being kept time” should read --so as to adjust to the timing of the--.

UNITED STATES PATENT AND TRADEMARK OFFICE

CERTIFICATE OF CORRECTION

PATENT NO. : 7,149,437 B2
APPLICATION NO. : 10/924923
DATED : December 12, 2006
INVENTOR(S) : Kazuhiro Okubo It is certified that error appears in the above-identified patent and that said Letters Patent is hereby corrected as shown below:

COLUMN 13:
Line 9, "the described" should read --those described--.
Line 27, "mode to" should read --mode--.

Signed and Sealed this

Fifteenth Day of May, 2007

JON W. DUDAS
*Director of the United States Patent and Trademark Office*